United States Patent [19]

Kornet et al.

[11] Patent Number: 4,787,604

[45] Date of Patent: Nov. 29, 1988

[54] SLAG RETENTION ON DISCHARGE OF A LADLE

[75] Inventors: Manfred Kornet, Moers; Hans U. Franzen, Duisburg; Josef Glaser, Duesseldorf, all of Fed. Rep. of Germany

[73] Assignee: Mannesmann AG, Duesseldorf, Fed. Rep. of Germany

[21] Appl. No.: 57,983

[22] Filed: Jun. 4, 1987

[30] Foreign Application Priority Data

Jun. 10, 1986 [DE] Fed. Rep. of Germany ..... 3619416

[51] Int. Cl.[4] ..... C21B 13/00

[52] U.S. Cl. ..... 266/44; 266/91

[58] Field of Search ..... 266/44, 91

[56] References Cited

U.S. PATENT DOCUMENTS

| | | | |
|---|---|---|---|
| 3,439,759 | 4/1969 | Rouanet | 266/236 |
| 3,814,914 | 6/1974 | List | 266/91 |
| 3,917,111 | 11/1975 | Berthet | 266/91 |
| 4,135,915 | 1/1979 | Kennard | 75/59.13 |

*Primary Examiner*—Peter D. Rosenberg

*Attorney, Agent, or Firm*—Ralf H. Siegemund

[57] ABSTRACT

Molten metal is discharged without slag from a ladle, vessel or the like having a closable bottom tap by weighing the vessel continuously and forming from the measuring values respective earlier and later average values as well as the difference thereof; that difference directly indicates the onset of inclusion of slag in the outflow so that the bottom top of the vessel can be closed when slag appears.

3 Claims, 2 Drawing Sheets

SLAG RETENTION ON DISCHARGE OF A LADLE

BACKGROUND OF THE INVENTION

Figure 1:
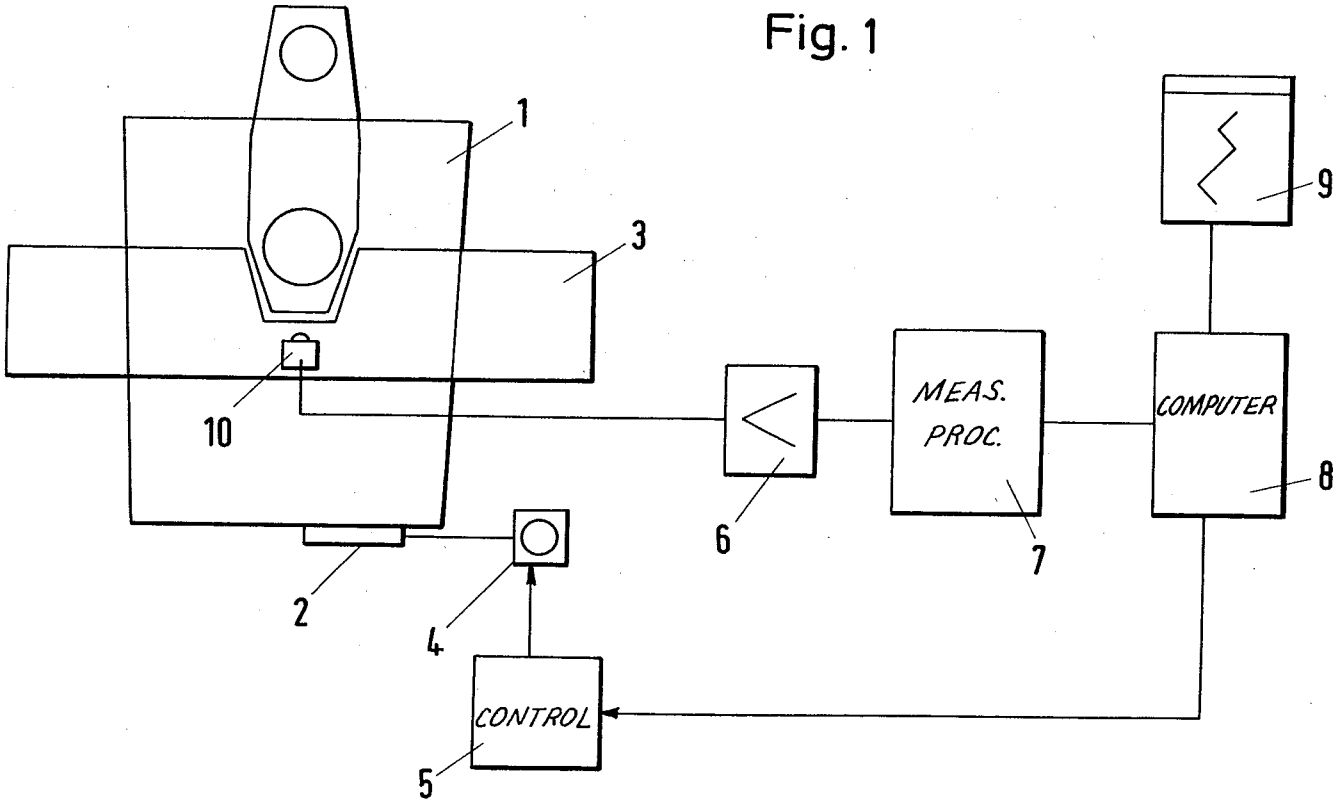

The present invention relates to the discharge of molten metal from a casting ladle or the like under exclusion of slag. The invention also relates to a method and equipment for slag-free removing molten metal from a ladle or other vessel having a bottom tap; the molten metal in the ladle being covered by a slag layer.

Discharging a ladle or any other metallurgical vessel in general requires that as early as possible the discharge of the slag together with molten metal be avoided. Of course in the case of a bottom tap for metal discharge generally there will be slag-free metal for a long time that flows out of the tap, but owing to various processes inside the ladle slag particles may at a fairly early time be sucked in and drawn into the outflow of the molten metal, and that is to be prevented. Optically recognizing the point in time when slag tends to be also discharged through the bottom tap is quite difficult since the slag will be sucked into an eddy; the slag moves actually in the interior of such an eddy. While an eddy can be recognized, it is difficult to determine at what point in time slag is actually sucked into the interior of the casting stream and eddy. The slag is usually visible when in the case of regular or continuous casting, slag provides precipitate again either on the top part of the casting or e.g. in the tundish that feeds the mold for continuous casting.

The slag location has been determined, for example, by means of electrically inductive measuring methods using the difference in electrical conductivity of metal and of slag, particularly in the stream of pouring metal. While technically quite adequate, the expenditure for the requisite equipment is too large and still the measuring result is not that accurate. German Pat. No. 28 14 699 proposes in the alternative to recognize the inclusion of slag by means of gravimetric methods.

DESCRIPTION OF THE INVENTION

It is an object of the present invention to improve gravimetric measurement techniques for recognizing the inclusion of slag in a pouring flow of molten metal such that the recognition obtained is very reliable.

In accordance with the preferred embodiment of the present invention it is suggested to provide the casting ladle or other vessel having a bottom tap on a weighing equipment i.e. a scale which yields measurement signals on a running basis and is called upon periodically preferably in intervals less than a second, and those average values are formed from plural sequential measuring values that these average values are used to form a differential quotient to be compared with a reference value and that deviations are interpreted as a case in which slag has now been included in the flow which fact is then used for closing the casting vessel, ladle or the like.

It is of advantage to use as a reference value a difference that has been ascertained before hand. This is based on the observation that under a given set of circumstances surrounding casting one does not have to determine in the abstract what the rate of flow during regular casting will be. In the first base of casting one knows that there is no slag inclusion so that the first difference values ascertained are regular ones and are representative of regular casting. Owing to the decline in ferrostatic pressure as casting continues, the rate of outflow will gradually drop. That rate is normally constant i.e. the second derivative is constant. Hence respective earlier difference or rate signals can now readily be used as reference with continuous updating of that reference until the beginning of a slag inclusion definitely provides a deviation from previous steady state casting conditions.

DESCRIPTON OF THE DRAWINGS

Figure 2:
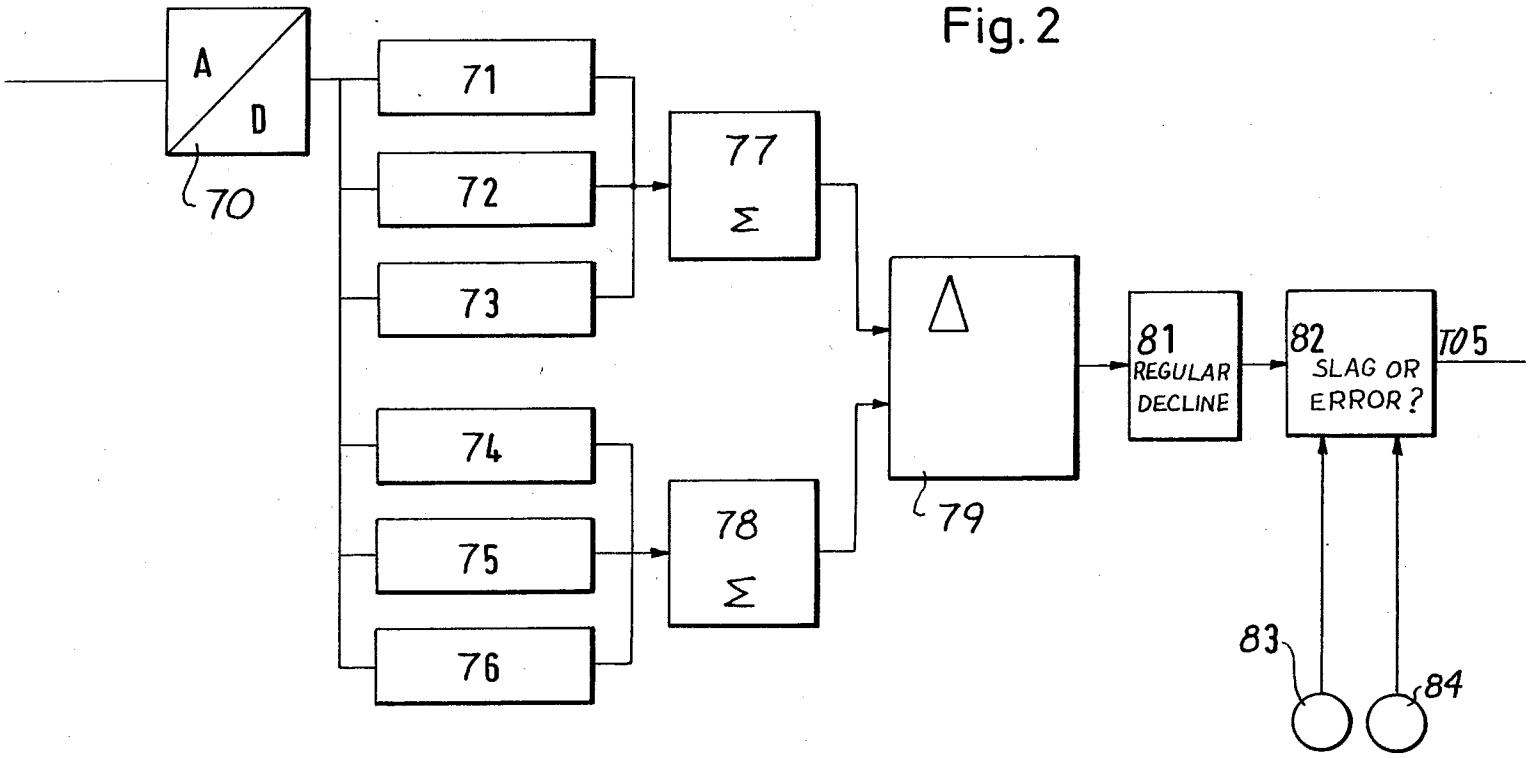

While the specification concludes with claims particularly pointing out and distinctly claiming the subject matter which is regarded as the invention, it is believed that the invention, the objects and features of the invention and further objects, features and advantages thereof will be better understood from the following description taken in connection with the accompanying drawings in which:

FIG. 1 is a block diagram and partially a schematic view of equipment for practicing the best mode of the invention within the purview of a preferred embodiment; and FIG. 2 is a block diagram and illustration for explaining the process that is used in conjunction with the invention.

Proceeding now to the detailed description of the drawings, FIG. 1 illustrates a casting vessel tundish or ladle 1 carried by a suitable carrier construction or the like, 3 and including e.g. a casting carriage, a crane, ladle with revolving tower. or the like. The vessel rests on a scale i.e. a weight measuring device constructed to include a pressure or force measuring transducer 10. The ladle or vessel 1 is provided with a bottom tap which is normally closed by means of a slide or gate 2. An adjusting drive 4 actuates the slide 2 such that its position can be controlled; the control and actuation being provided by a control circuit 5 controlling the drive 4.

The bottom tap of vessel 1 is controlled particularly so that a particular amount of metal e.g. steel can discharge from the ladle per unit time. During the discharge of the metal the weight of the ladle or vessel 1 is continuously measured by means of the device 10. Any change in weight per unit time determines in fact the rate of casting in terms of tons of steel cast per minute.

Reference numeral 6 refers to the immediate electronic circuitry operated by the weighing transducer 10. It provides an amplified useful signal which is exactly indicative of the weight as it occurs in any given time. This signal is fed to a circuit 7 which generally will determine whether there is a change in the outflow rate and any deviation of that rate signal from normal will be used to determine whether or not slag runs along.

Recognizing this signal relation is subject to a plausibility determination in a computer 8. In particular this plausibility control eliminates external influences such as changes, desired or undesired, of the slide movement of the structure carrying the ladle and other changes which may be responsible for a (incorrectly) recognized change in weight. This way one can eliminate other factors from the particular type or kind of influence which is to recognize namely a weight change that deviates from previous weight changes because slag is included. Generally speaking reference numeral 9 refers to a plotter that plots important measuring results.

FIG. 2 shows in detail what transpires in the circuits 7 and 8. The signal as it is derived from the circuit 6 is fed to an analog-to-digital converter 70 included in the circuit 7 to digitize the measuring value. The measuring values are cyclically fed into six storage registers 71 through 76. These may be components of the computer 8. After all six values have been ascertained one forms the sum of the content of registers 71,72 and 73 and feeds the sum to a summing circuit 77 while the circuit 78 establishes the sum of the content of the register 74,75 and 76. 77 and 78 may actually represent adding functions in the computer. Block 79 symbolizes the subtraction of the second sum from the first sum as respectively provided by summing circuits 77 and 78. It should be noted that the summing and subtracting functions will be expected to be provided by one and the same processor in a computing facility as is conventional but it is of advantage to separate these functions for illustrative purposes.

The computer 8 determines whether the averages established sequentially in the described fashion correspond to the normal regular and expected rate of casing flow. The function block 81 represents the operation of the computer determining whether the weight loss of the casting vessel follows the desired rate of metal flow without slag inclusion. For a constant flow rate the difference between the two sums formed in 79 on a running basis must be larger than a particular tolerance range, and of course it must be continuously positive i.e. later average weight values must be smaller than the earlier ones.

In addition and separately it is determined by a separate transducer 83 whether the slide 2 was moved or has moved during the period of time that enters into the formation of a particular difference value. Separately, equipment shaking is determined by a suitable transducer 84 and is separately ascertained so as to exclude faulty data. Specifically, when such undesired interference occurs, the weight measuring values obtained during such interference may be faulty and are suppressed. this is the function of block 83 which thus separates true slag flow recognition when the difference or differential as obtained drops to smaller values than tolerable. The computer will thus provide representative weight loss values and if these measuring values drop outside of a tolerance range then a signal is provided to the control 5 for the adjusting drive 4 cause gate 2 to close the gap in order to interrupt the metal flow from the ladle 1 because slag is now included at an increasing rate of the flow. Hence, the inventive method and equipment permits recognition of the inclusion of slag in the casting flow as it emerges from the vessel as soon as it no longer participates in the weight measurements. It was found that this method is very sensitive and that even small amount of slag will already trigger an indication so as to interrupt the flow of metal prior to having significant amounts of slag included in the outpouring stream.

The invention is not limited to the embodiments described above but all changes and modifications thereof, not constituting departures from the spirit and scope of the invention, are intended to be included.

We claim:

1. Method of insuring slag-free discharge of molten metal from a ladle or vessel having a bottom tap being closable and openable by a closure element, comprising the steps of:

weighing said vessel continuously and providing a sequence of weight indicating values on a running basis;

forming from said measuring values respective earlier and respective later average values and forming difference values on a running basis between the earlier and later measuring values;

determining by comparing the difference values with a reference value or values whether or not the rate of outflow of metal from the vessel suddenly decreases and thereby directly indicates the inclusion or absence of slag; and closing the bottom top of said vessel when slag inclusions are ascertained.

2. Method in claim 1 including the step of separately ascertaining interferences in terms of external forces that may interfere with the weight measurement and to exclude measuring values determined during such periods of interference.

3. Method as in claim 1 and including the step of providing the reference value as an earlier measuring value as ascertained.

* * * * *